US006517265B2

(12) United States Patent
Evans et al.

(10) Patent No.: US 6,517,265 B2
(45) Date of Patent: Feb. 11, 2003

(54) LOSS OF FUNDS PREVENTION FOR POSTAGE METERS AND PERSONAL COMPUTER METERS

(75) Inventors: John V. Evans, Brookfield, CT (US); Al Ewers, Colchester, CT (US); David L. Rich, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/850,598

(22) Filed: May 7, 2001

(65) Prior Publication Data

US 2002/0164184 A1 Nov. 7, 2002

(51) Int. Cl.[7] ..... B41J 2/42

(52) U.S. Cl. ..... 400/74; 101/91; 347/7; 705/408

(58) Field of Search ..... 400/74, 70, 6, 400/4, 3; 101/45, 47, 91, 92, 93; 347/2, 7, 19, 23; 705/401–411; 283/71; 250/568

(56) References Cited

U.S. PATENT DOCUMENTS 5,321,436 A * 6/1994 Herbert ..... 250/568
5,816,147 A 10/1998 Manduley et al. ..... 101/91
6,000,774 A * 12/1999 Nambudiri ..... 347/7
6,111,951 A * 8/2000 Guenther ..... 235/375
6,188,996 B1 * 2/2001 Sansone ..... 705/408

* cited by examiner

*Primary Examiner*—Andrew H. Hirshfeld
*Assistant Examiner*—Minh H. Chau
(74) *Attorney, Agent, or Firm*—Ronald Reichman; Angelo N. Chaclas

(57) ABSTRACT

In a postage meter, funds are requested from an accounting unit and transferred to a print buffer when a print registration sensor detects a mailpiece at a location that is sufficiently downstream of the printing mechanism in order to enable the meter sufficient time to compose the indicia. A presentation sensor detects the presence of the mailpiece just prior to printing the indicia; and a printing mechanism prints the indicia if the mailpiece is properly aligned with the printing mechanism, or stores the indicia data in a secure register if the mailpiece is not properly aligned with the printing mechanism to enable the operator to obtain a refund.

9 Claims, 2 Drawing Sheets

LOSS OF FUNDS PREVENTION FOR POSTAGE METERS AND PERSONAL COMPUTER METERS

FIELD OF THE INVENTION

The invention relates generally to the field of postal devices and, more particularly, to preventing postal devices from losing funds from certain types of errors.

BACKGROUND OF THE INVENTION

Since the issuance of U.S. Pat. No. 1,530,852 to Arthur H. Pitney, Mar. 24, 1925, the postage meter has had a steady evolution. Each meter has had a printer included therein on a one-on-one basis, i.e., one metering device and one printing device incorporated into a unit. In postage meters, the need for security is absolute. Such security is applied to postage meters, both to the printing portion of the meter and the accounting portion. The reason for the need for absolute security is that a postage meter is printing value, and unless security measures are taken, one would be able to print unauthorized postage, i.e., postage for which no payment is made, thereby defrauding the post office.

Prior art postage meters included an accounting portion, a postal indicia printing portion and a control portion that was coupled to the accounting portion and the printing portion. Some postage meters utilized transfer printing techniques to print the postal indicia on a mailpiece or label. Transfer printing or offset printing was accomplished by affixing a plate bearing a postal indicia to a portion of a printing drum or cylinder that received ink from an inking roller, and then transferring the inked postal indicia or indicia imprint to a mailpiece or label. The prior art also utilized a print head instead of an inking roller to supply an inked postal indicia to the printing drum or cylinder. When the printing drum commenced rotating, the value of the postal indicia was subtracted from the accounting portion of the postal meter, and the postal indicia was imprinted on the mailpiece when the indicia portion of the printing roller came in contact with the mailpiece.

Typically, a photocell was placed before the printing drum. The photocell would detect the presence of a mailpiece, which detection would cause the printing drum to start rotating. Then the value of the postal indicia would be subtracted from the accounting portion of the postal meter. Thus, if the mailpiece was not in proper alignment with the printing drum, the accounting portion of the postal meter would deduct the value of the postal indicia, even though the postal indicia was not properly printed on the mailpiece. The user of the postage meter was charged for the amount of money deducted by the accounting unit even though the mailpiece did not have the proper indication that postage had been paid. If the user wanted a refund for the amount of money deducted by the accounting unit, the user would have to physically bring the mailpiece with the improperly printed indicia to the post. The foregoing was inconvenient and oftentimes did not justify going to the post office to receive a small amount of money.

Digital postage meters have been developed that produce encrypted indicias on mailpieces in order to reduce postal fraud. A finite amount of time is required to construct the digital indicia. Thus, a leading edge mailpiece sensor may be placed a distance away from the location that an indicia will be printed on the mailpiece so that the meter may have sufficient time to compose the indicia. As digital postage meters get faster, the above method of producing indicia will either limit the speed of producing the indicia or force the digital postage meter to mailpiece travel path to be physically longer. The moment that the digital meter began constructing the indicia, the accounting unit deducted the amount of postage that was going to be affixed to the mailpiece. Hence, if the indicia was improperly printed on the mailpiece, the user would have to physically bring the mailpiece with the improperly printed indicia to the post to obtain a refund.

Personal computer meters that print postage and virtual meters that print postage have been developed that produce information-based indicias on mailpieces to reduce postal fraud. A personal computer meter includes a personal computer, a personal security device and a printer. A virtual meter includes a personal computer, a printer and a data center. Once a decision to print an information-based indicia has been made by a personal computer meter or a virtual meter, the meters will be charged for the postage printed in the information-based indicia even if the mailpiece jams in the printer and the indicia is not useable. If the user wanted a refund for the improperly printed indicia, the user would have to bring the mailpiece to the post.

SUMMARY OF THE INVENTION

This invention overcomes the disadvantages of the prior art by not requiring users of meters that print postage to return to the post those indicias that are affixed to mailpieces that have been printed improperly due to improper alignment of the mailpiece with the printer or the jamming of the printer. An additional advantage of this invention is that the sensor in postage meters that initiates the indicia formation process may be located at a point upstream of the indicia printing mechanism, where the mailpiece is not properly aligned in order to reduce the footprint of the postage meter. The foregoing is accomplished by requesting funds from the accounting unit and transferring the funds to a print buffer when a print registration sensor detects the mailpiece at a location that is sufficiently downstream of the printing mechanism in order to enable the meter sufficient time to compose the indicia; checking the orientation of the mailpiece with a sensor just prior to printing the indicia; and printing the indicia if the mailpiece is properly aligned with the printing mechanism, or storing the indicia data (information contained in the indicia in a digital format together with a digital signature that uniquely identifies the specific funds dispensed by an accounting unit for a particular indicia) in a dedicated secure register if the mailpiece is not properly aligned with the printing mechanism. The operator of the meter may then request, at a time convenient to the operator, that the post to refund or credit the amount of monies stored in the dedicated secure register via Postage By Phone® or the internet. Postage By Phone® is a system designed and operated by Pitney Bowes Inc. of One Elmcroft Road, Stamford, Conn. 06926, that allows postage meters to receive funds over the telephone lines.

DETAILED DESCRIPTION OF THE PREFERRED EMBODIMENT

Figure 1:
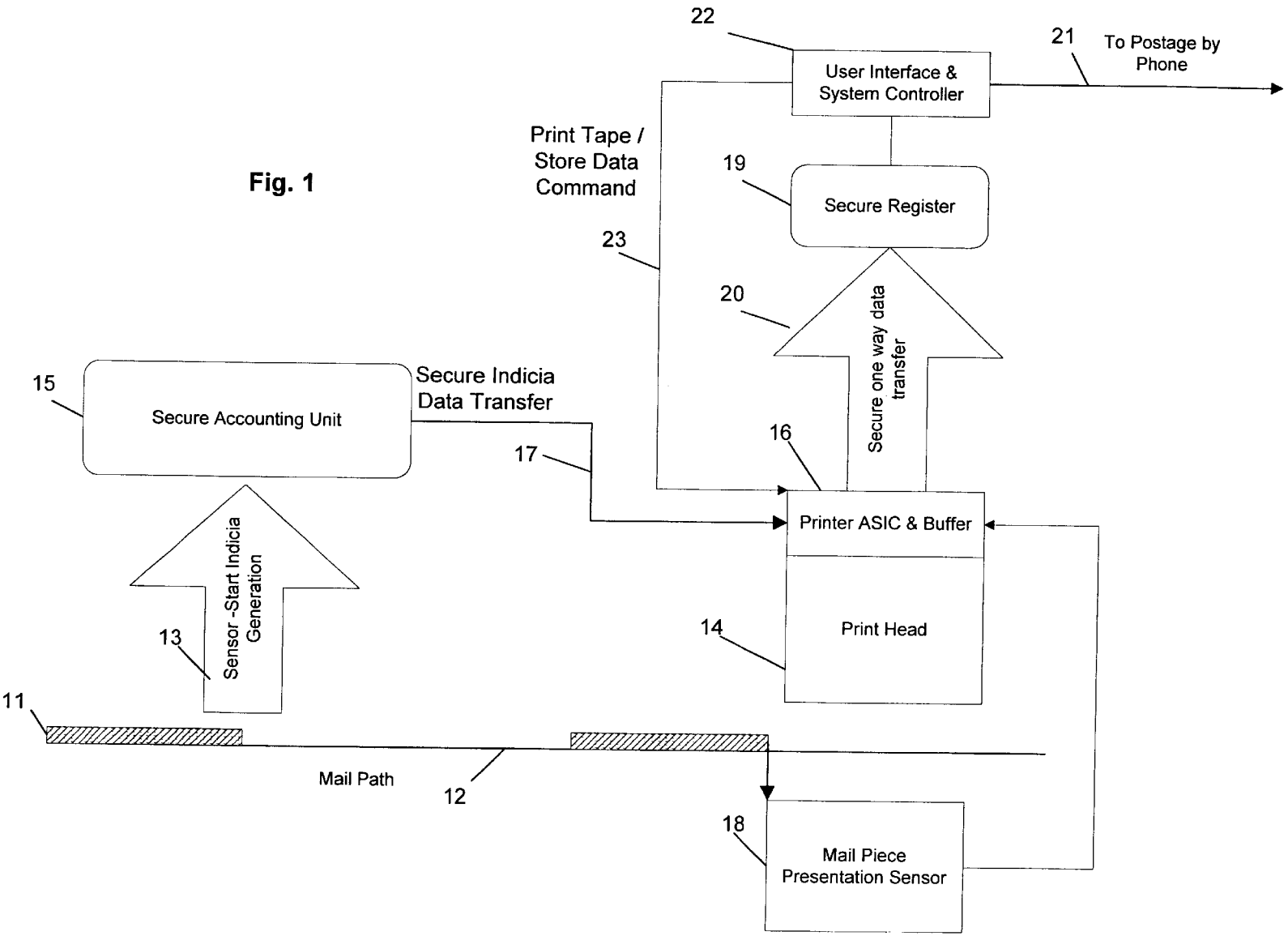
FIG. 1 is a drawing of the apparatus of this invention.

Referring now to the drawings in detail, and more particularly to FIG. 1, the reference character 11 represents a mailpiece that is moved along a mail path 12. A sensor 13 is located sufficiently upstream of print head 14 along mail path 12 at a position that enables the postal indicia to be completed before mail piece 11 reaches print head 14. Sensor 13 detects the presence of the leading edge of mailpiece 11. Sensor 13 is coupled to secure accounting unit 15, i.e., a postal security device or a secure register, etc. Unit 15 generates indicia data (information contained in the indicia in a digital format together with a digital signature that uniquely identifies the specific funds dispensed by an accounting unit for a particular indicia) that may be printed on mailpiece 11. The indicia data is securely transmitted to printer Application Specific Integrated Circuit Chip ("ASIC") and buffer 16 via line 17. Printer ASIC and buffer 16 composes an image of a postal indicia from the indicia data. Mailpiece presentation sensor 18, i.e., a skew sensor, registration sensor, etc. is located along mail path 12 slightly upstream of print head 14.

If sensor 17 determines that mailpiece 11 is properly aligned along mail path 12 with print head 14, sensor 18 will inform ASIC 16 of this fact. ASIC 16 will cause print head 14 to print the completed postal indicia on mailpiece 11. If sensor 18 determines that mailpiece 11 is not properly aligned along mail path 12 with print head 14, sensor 18 will inform ASIC 16 of this fact. ASIC 16 will cause the postal indicia data to be removed from the buffer in ASIC 16 and transmitted to secure register 19 via secure one way funds transfer path 20. An operator may then request, at a time convenient to the operator the post to refund or credit the amount of monies stored in the dedicated secure register 19 via a postage refill and redemption system, i.e., Postage By Phone® 21 or the internet. In the alternative, the operator may request that print head 14 print the postal indicia on a paper tape which may be affixed to the mailpiece. The operator may be prompted via the system's user interface 22 to choose either 1) print indicium to paper tape; or 2) store funds for later redemption. Alternatively, the operator may set a default "preferred method" for handling mis-registered mail piece errors.

Figure 2:
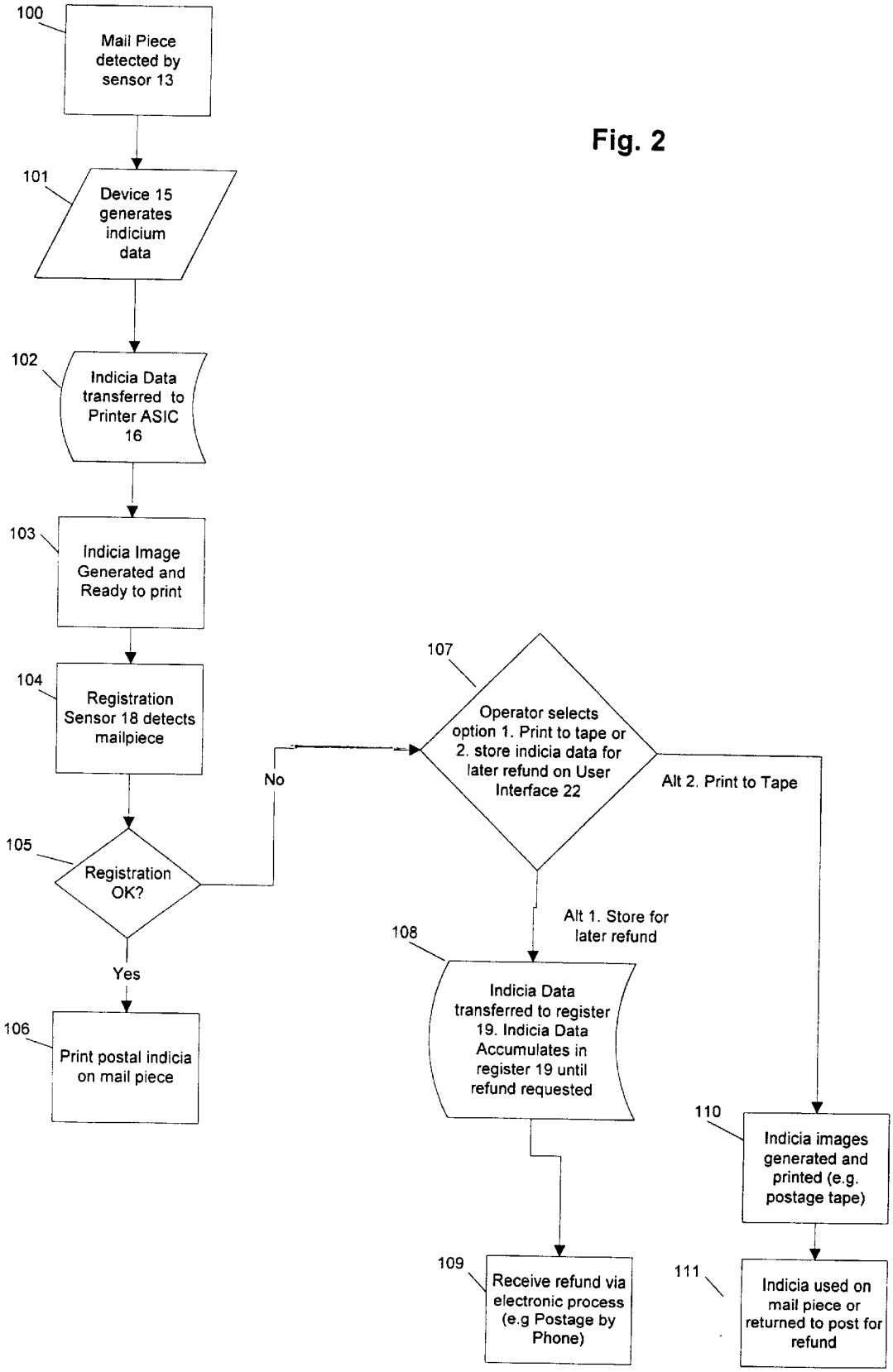
FIG. 2 is a drawing of a flow chart showing the process of this invention.

FIG. 2 is a drawing of a flow chart showing the process of this invention. The process begins in step 100, when a mailpiece travelling along mail path 12 is detected by sensor 13. Then in step 101, secure accounting unit 15 generates indicia. The generated indicia may be for an Information-Based Indicia or other postal indicias that may be printed by an electronic printer. In step 102 the indicia data is transmitted to ASIC 16. Then in step 103, the indicia image is generated by ASIC 16 in a form that the indicia may be printed. After sufficient time has elapsed for mailpiece 11 to travel along mail path 12, presentation sensor 18 detects mail piece 11 at step 104. In step 105, sensor 18 will determine whether or not mailpiece 11 is properly aligned with print head 14. If mailpiece 11 is properly aligned with print head 14, step 106 will be the next step. In step 106 print head 14 will print the postal indicia on mailpiece 11.

If mailpiece 11 is not properly aligned with print head 14, step 107 will be the next step. In step 107, the operator will instruct the system via the user interface 22 either to print the current indicia to tape or to store it for later refund via command 23. If the data is to be store for later refund, then in step 108, the data stored in ASIC buffer 16 will be transmitted to secure register 19. If the operator elects to have the postage represented by the indicia that was not printed refunded by Postage By Phone®, the next step will be step 109. In step 109, Postage By Phone® will credit the meter for the funds that were deducted from accounting unit 15 to pay for the postal indicia that was not printed.

If the operator elects to have the postage represented by the indicia that was not printed because the mailpiece was not properly aligned, then step 110 will be the next step. The indicia images will be generated and will be printed on a postage tape in step 110. In step 111 the operator may affix the postage tape to a mailpiece or return the postage tape to a post office for a refund.

The above specification describes a new and improved system that prevents postal devices from losing funds from certain types of errors. It is realized that the above description may indicate to those skilled in the art additional ways in which the principles of this invention may be used without departing from the spirit. Therefore, it is intended that this invention be limited only by the scope of the appended claims.

What is claimed is:

1. A postage metering system having an accounting unit for deducting the amount of postage used from the amount of postage purchased and a printing mechanism for printing a postal indicia containing postage, the improvement comprising:

a first sensor that detects a mailpiece at a location upstream of the printing mechanism in order to enable the metering system sufficient time to compose the indicia;

a second sensor slightly upstream of the printing mechanism so that the second sensor may determine whether or not the mailpiece is properly aligned with the printing mechanism, whereby the printing mechanism will print the indicia if the mailpiece is properly aligned with the printing mechanism; and a buffer for holding indicia data coupled to the second sensor; and whereby the printing mechanism will not print the indicia and store funds that are deducted from the accounting unit in the buffer if the mailpiece is not properly aligned with the printing mechanism.

2. The system claimed in claim 1, further including:

a secure register coupled to the buffer for collecting and holding the buffer funds for indicias that were not printed.

3. The system claimed in claim 2, further including:

a redemption system coupled to the secure register for crediting the meter for the funds transmitted from the secure register to the redemption system.

4. The system claimed in claim 2, whereby the funds in the buffer are printed on a postage tape that may be returned to the post for a refund.

5. The system claimed in claim 2, whereby the funds in the buffer are printed on a postage tape that may be affixed to a mailpiece.

6. A metering device comprising:

an accounting unit for generating an indicia;

a first sensor coupled to the accounting unit, the first sensor providing a signal to the accounting unit upon detection of a mailpiece, the accounting unit generating an indicia for the mailpiece in response to the signal from the first sensor;

a printing mechanism to print the generated indicia;

a controller to control the printing of the indicia by the print mechanism;

a second sensor coupled to the controller, the second sensor being located between the first sensor and the printing mechanism, the second sensor providing a signal to the controller based on alignment of the mailpiece with the printing mechanism; and a postage tape, wherein if the second sensor does not detect proper alignment of the mailpiece with the printing mechanism, the controller, based on the signal from the second sensor, controls the print mechanism to automatically print the generated indicia on the postage tape.

7. A method for generating and printing an indicia comprising the steps of:

detecting a mailpiece;

generating an indicia for the mailpiece;

determining if the mailpiece is properly aligned with a printing mechanism to print the generated indicia;

printing the generated indicia on the mailpiece if the mailpiece is properly aligned with the printing mechanism; and automatically printing the generated indicia on a tape if the mailpiece is not properly aligned with the printing mechanism.

8. The method according to claim 7, wherein the step of determining if the mailpiece is properly aligned further comprises:

determining if the mailpiece is skewed.

9. The method according to claim 7, wherein the step of determining if the mailpiece is properly aligned further comprises:

determining if the mailpiece is jammed before reaching the printing mechanism.

* * * * *

UNITED STATES PATENT AND TRADEMARK OFFICE

CERTIFICATE OF CORRECTION

PATENT NO. : 6,517,265 B2
DATED : February 11, 2003
INVENTOR(S) : John V. Evans et al.

It is certified that error appears in the above-identified patent and that said Letters Patent is hereby corrected as shown below:

Title page,
Item [75], add -- Gary S. Jacobson -- as an inventor.

Signed and Sealed this

Nineteenth Day of August, 2003

JAMES E. ROGAN
*Director of the United States Patent and Trademark Office*